US005794787A

United States Patent [19]

Johnston

[11] Patent Number: 5,794,787

[45] Date of Patent: Aug. 18, 1998

[54] MOBILE GRAVEL SCREENING APPARATUS

[76] Inventor: Rafe Johnston, R.F.D. #3, Box 366A, Caribou, Me. 04736

[21] Appl. No.: 570,108

[22] Filed: Dec. 11, 1995

Related U.S. Application Data

[63] Continuation-in-part of Ser. No. 258,220, Jun. 10, 1994, Pat. No. 5,673,893.

[51] Int. Cl.[6] ..... B07B 1/49

[52] U.S. Cl. ..... 209/420; 209/935

[58] Field of Search ..... 209/367, 366.5, 209/364, 366, 420, 421, 326, 405, 409, 244, 325, 935, 240

[56] References Cited

U.S. PATENT DOCUMENTS 4,237,000 12/1980 Read et al. ..... 209/420
4,699,713 10/1987 Tieben ..... 209/420
4,923,597 5/1990 Anderson et al. ..... 209/935
5,368,167 11/1994 Howes ..... 209/409

*Primary Examiner*—Kenneth Noland
*Attorney, Agent, or Firm*—Frederick R. Cantor, Esq.

[57] ABSTRACT

A mobile screening apparatus for gravel and other aggregates includes a three sided box adapted to rest on the ground surface. A vibrating screen is located above the box in a tilted, or sloped condition, so that gravel deposited on the screen is in a fluidized condition. Relatively fine gravel particles (stones) pass downwardly through the screen into the box. Two upwardly divergent trough walls are rigidly secured to side edges of the screen to guide gravel particles onto the screen. A rotary motor is mounted on the undersurface of the screen to rotate an elongated shaft that acts as a counterweight to oscillate the screen in a generally vertical direction. The motor and elongated counterweight shaft are exposed so as to be readily accessible for inspection or maintenance purposes.

7 Claims, 2 Drawing Sheets

MOBILE GRAVEL SCREENING APPARATUS

REFERENCE TO A RELATED PATENT APPLICATION

This is a continuation-in-part of my patent application, Ser. No. 258,220, filed on Jun. 10, 1994 now U.S. Pat. No. 5,673,853.

BACKGROUND OF THE PRESENT INVENTION

FIELD OF THE INVENTION

The present invention relates to a mobile gravel screening apparatus.

The present invention, more particularly, relates to a mobile gravel screening apparatus having a sloped screen, and means for vibrating the screen to promote the flow of gravel through the apparatus.

PRIOR DEVELOPMENTS

It is known that aggregate mixtures can be separated into different particle size fractions by depositing such aggregate mixtures onto a sloped screen while vibrating the screen in a vertical, or near-vertical, direction. Relatively coarse particles are retained on the screen, while the finer (smaller size) particles fall through the screen openings.

Depending on the direction of screen vibration, the screen oscillation causes the particles on the screen to assume a floating fluidized condition wherein individual particles are spaced slightly from adjacent particles. The smaller size particles thereby have an improved capability for finding a screen opening for gravitational separation from the coarser particles.

Vibrating screen systems have been used for separating various types of aggregates, e.g., gravel mixtures, mixtures of stones and dirt, and dirt having agglomerated clumps of clay.

Vibrating screen systems have been embodied in trailers for towing to places where the aggregates are located. In most cases the vibrating screens have been mounted within housings that have funnel-like hoppers located above the screens. These hoppers act as guides for funnelling the aggregates onto the screen. Such hoppers are advantageous in that they form relatively wide mouths for receiving the aggregates, whereby there is a lessened possibility of aggregates missing or bypassing the screens. Also, there is a better distribution of the aggregate mass on the screen.

One disadvantage of the known mobile (trailered) screen systems is that the funnel-like hoppers are stationary, whereas the associated screens are oscillatory. The screens have to be spaced from the hopper surfaces in order to permit the desired oscillatory (vibratory) motions of the screen. The resulting clearances between the screen and hopper form concealed cracks and crevices that can serve as collection points for particles.

Particulates accumulating in such concealed cracks and crevices can eventually interfere with the oscillatory motion of the screen, to the point where the screen no longer vibrates in the desired fashion. In extreme cases the clearance areas will be sufficiently clogged to prevent the screen from vibrating entirely.

U.S. Pat. Nos. 4,237,000; 4,923,597; 4,256,572; 5,106,490; and 5,232,098, show mobile screen systems that have heretofore been proposed for use in separating aggregate mixtures into coarse and fine fractions. The present invention is concerned with a simplified mobile screen system that is an improvement on the systems shown in these patents; the principal area of improvement is that the screen is elevated above the box which receives the fine aggregates, whereby aggregates are precluded from clogging the system so as to prevent the screen from oscillating in the desired fashion. The elevated screen has two trough walls attached thereto for guiding aggregates onto the screen, whereby the screen is fully utilized.

SUMMARY OF THE PRESENT INVENTION

An object of the present invention is to provide a mobile gravel screening apparatus.

A further object of the present invention is, more particularly, to provide a mobile gravel screening apparatus having a sloped screen, and means for vibrating the screen to promote the flow of gravel through the apparatus.

In a preferred embodiment, the present invention comprises a box adapted to rest on the ground surface, and a vibratable screen assembly located above the box. Six heavy duty coil springs support the screen assembly for oscillatory motion in the space above the box, whereby aggregates deposited onto the screen achieve a fluidized condition suitable for gravitational movement of the smaller size particulates through the screen openings into the subjacent box.

A motor operated counterweight shaft system is provided on the screen assembly to oscillate the screen assembly in a generally vertical direction, under the control of the six heavy duty coil springs. Preferably, the counterweight comprises an elongated shaft extending the full width of the screen assembly. Typically the shaft has a diameter of about four inches, such that the shaft has a desired radial and torsional stiffness. The elongated, relatively large diameter, shaft is largely free from such deflections as would detract from the desired screen oscillation action; all of the motor energy put into the counterweight shaft is translated into screen oscillation rather than shaft deflection.

In preferred practice of the invention, the elevated screen assembly includes two divergent trough walls contiguous with side edges of the screen for guiding aggregates onto the screen surface. The upper edges of the trough walls are widely spaced to provide a wide-mouthed hopper structure for receiving aggregates from an overhead source, e.g., a belt conveyor or the shovel of a front end loader.

The trough walls are integral parts of the screen assembly, so that there is no potential for particulates to become clogged between the trough and the screen assembly. As a result, the oscillation system enjoys a relatively long service life, without becoming clogged, or jammed, due to particulate accumulations.

The structure of the present invention is advantageous in that the oscillation mechanism and screen assembly are fully exposed above the particulate collection box, whereby the technician can immediately detect maintenance problems, e.g., a leaking hydraulic hose. The operating components are easily accessible so that repairs can be quickly accomplished without dismantling housing structures or other components of the system.

A principal aim of the invention is to provide a mobile vibrating screening system having a relatively long service life, and a very low maintenance expense, with minimal down time when repairs are needed.

In summary, and in accordance with the above discussion, the foregoing objectives are achieved in the following embodiments.

1. A mobile aggregate screening apparatus comprising:

a box adapted to rest on the ground surface;

said box comprising a rear wall, a side wall, and a front wall; said front and rear walls having upper edges sloped downwardly in the direction of said box side wall;

a vibratable screen assembly located above said box;

said screen assembly comprising a rectangular frame located in a sloped plane approximately parallel to the plane of said sloped upper edges, a sloped perforated panel positioned on said frame, and two upwardly divergent trough walls extending upwardly from said rectangular frame in contiguous relation to said perforated panel, whereby aggregates deposited onto said trough walls are gravitationally guided onto the perforated panel; and a rotary counterweight system for vibrating said screen assembly in a generally vertical direction;

said counterweight system comprising two aligned bearings mounted on said rectangular frame, and an elongated shaft supported in said bearings for rotary movement around a rotational axis defined by the bearings;

said elongated shaft having a principal axis offset from the bearing axis, whereby said shaft acts as a counterweight.

2. The aggregate screening apparatus, as described in paragraph 1, and further comprising a motor mounted on the screen assembly frame in direct driving connection to said elongated shaft.

3. The aggregate screening apparatus, as described in paragraph 2, wherein said elongated shaft comprises a main body portion (81) and two end portions extending from said main body portion through said bearings; and said shaft end portions having a lesser diameter than said main body portion.

4. The aggregate screening apparatus, as described in paragraph 2, and further comprising plural coil springs extending between said box and the rectangular frame of said screen assembly, whereby the screen assembly is resiliently supported above the box; and said coil springs comprising three coil springs extending upwardly from the upper edge of the box front wall, and three coil springs extending upwardly from the upper edge of the box rear wall.

5. The aggregate screening apparatus, as described in paragraph 4, wherein the coil springs are equidistantly spaced along the respective front and rear walls of the box.

6. A mobile gravel screening apparatus comprising:

a three sided box having an open top and an open bottom, said box having a rear wall, a side wall, and a front wall;

a pair of road wheels located in near proximity to said rear wall for supporting said box in a raised position spaced above the ground surface;

means for retracting said wheels upwardly whereby said box can be lowered to rest on the ground surface;

a platform extending forwardly from said box front wall;

a lowerable landing leg extending downwardly from said platform for supporting said platform in a raised or lowered position;

said front and rear walls of the box having upper edges sloped downwardly in the direction of said box side wall;

a vibratable screen assembly located above said box;

said screen assembly comprising a rectangular frame located in a sloped plane approximately parallel to the plane of said sloped upper edges on the box front and rear walls;

said screen assembly further comprising a sloped perforated panel positioned on said frame, said perforated panel having two parallel edges paralleling the plane of the box front and rear walls, and two trough walls extending upwardly from said frame for channeling gravel onto the perforated panel;

said trough walls having lower edges in near proximity to said parallel edges on the perforated panel;

said trough walls having upper edges spaced further apart than said lower edges, whereby gravel discharged into the screen assembly is guided onto the perforated panel;

means for vibrating said screen assembly;

said vibrating means comprising an engine mounted on said platform, a hydraulic pump driven by said engine, and a hydraulic motor mounted on said rectangular frame;

a rotary counterweight system for vibrating said screen assembly in a generally vertical direction;

said counterweight system comprising two aligned bearings (85) on said rectangular frame, and an elongated shaft having reduced diameter end portions supported in said bearings, whereby said shaft is rotatable around a rotational axis defined by the bearings; and said elongated shaft having a principal axis offset from the bearing axis, whereby said shaft serves as a rotary counterweight.

7. The gravel screening apparatus, as described in paragraph 6, and further comprising coil spring means extending between said box and the rectangular frame of said screen assembly, whereby the screen assembly is resiliently supported above the box; and said coil spring means comprising three equidistantly spaced coil springs extending from the upper edge of said box rear wall, and three equidistantly spaced coil springs extending from the upper edge of said box front wall.

A BRIEF DESCRIPTION OF THE DRAWINGS

DESCRIPTION OF THE PREFERRED EMBODIMENTS OF THE PRESENT INVENTION.

Figure 1:
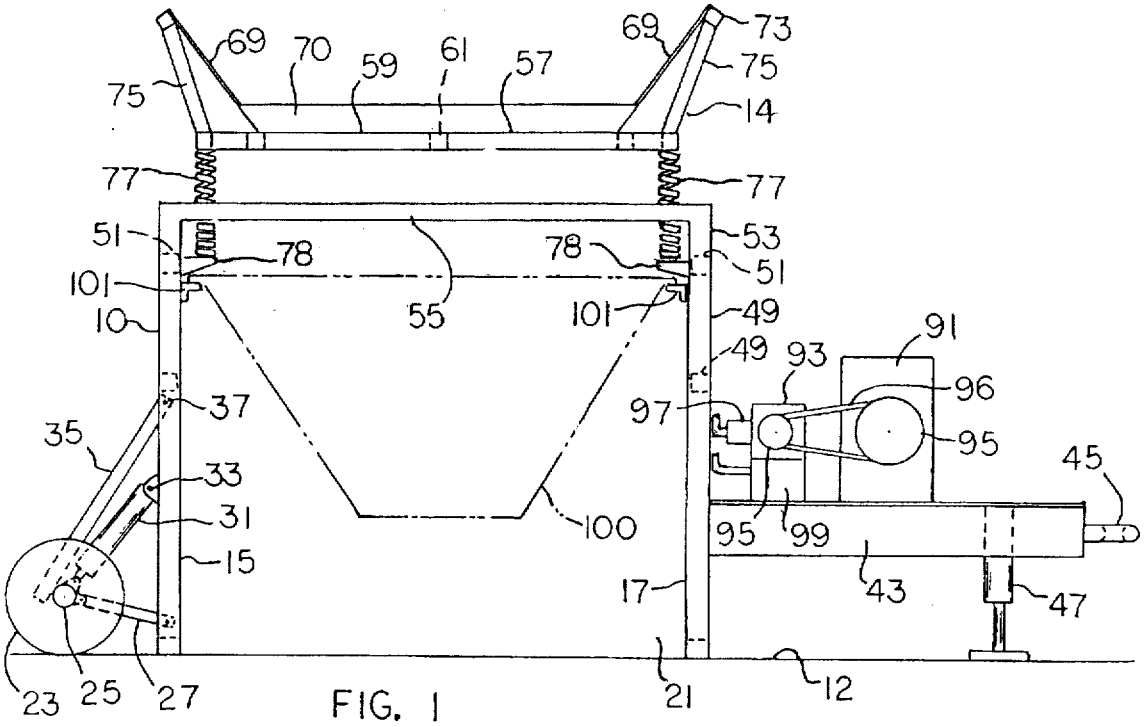
FIG. 1, is a side elevational view, of a mobile aggregate screening apparatus embodying the invention.

FIG. 1, is a side elevational view, of a mobile aggregate screening apparatus embodying the invention.

Figure 2:
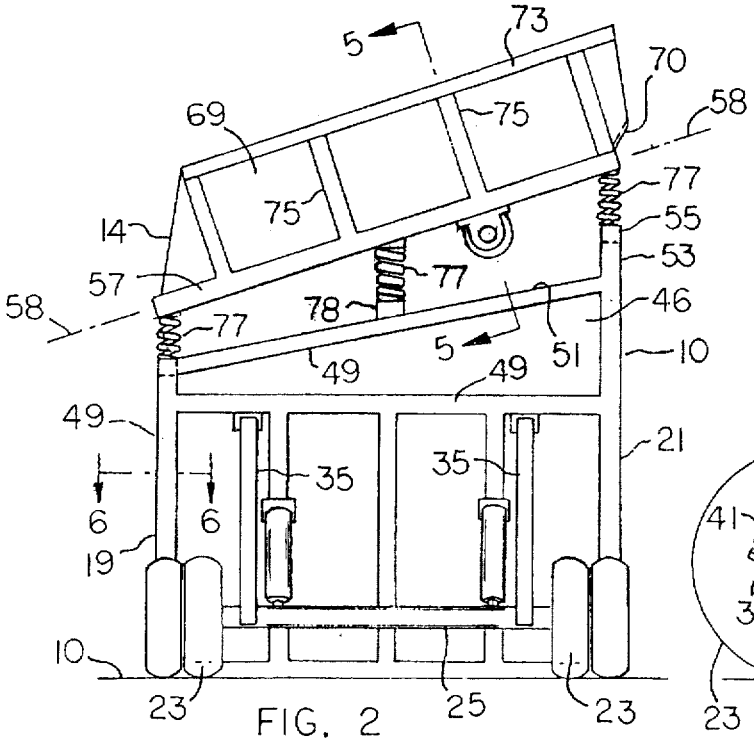
FIG. 2, is a left end elevational view, of the FIG. 1 screening apparatus.

FIG. 2, is a left end elevational view, of the FIG. 1 screening apparatus.

Figure 3:
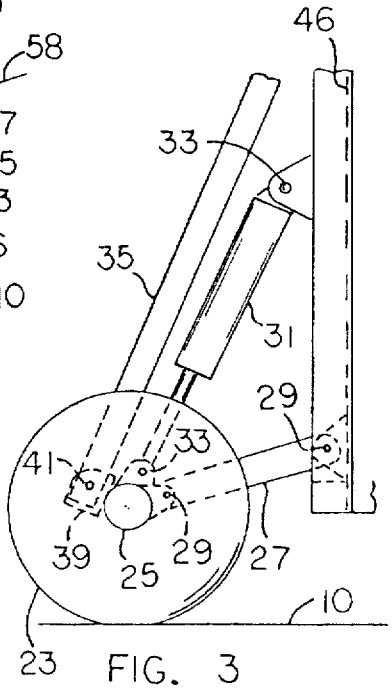
FIG. 3, is an enlarged fragmentary view, of a road wheel mounting mechanism used in the FIG. 1 apparatus.

FIG. 3, is an enlarged fragmentary view, of a road wheel mounting mechanism used in the FIG. 1 apparatus.

Figure 4:
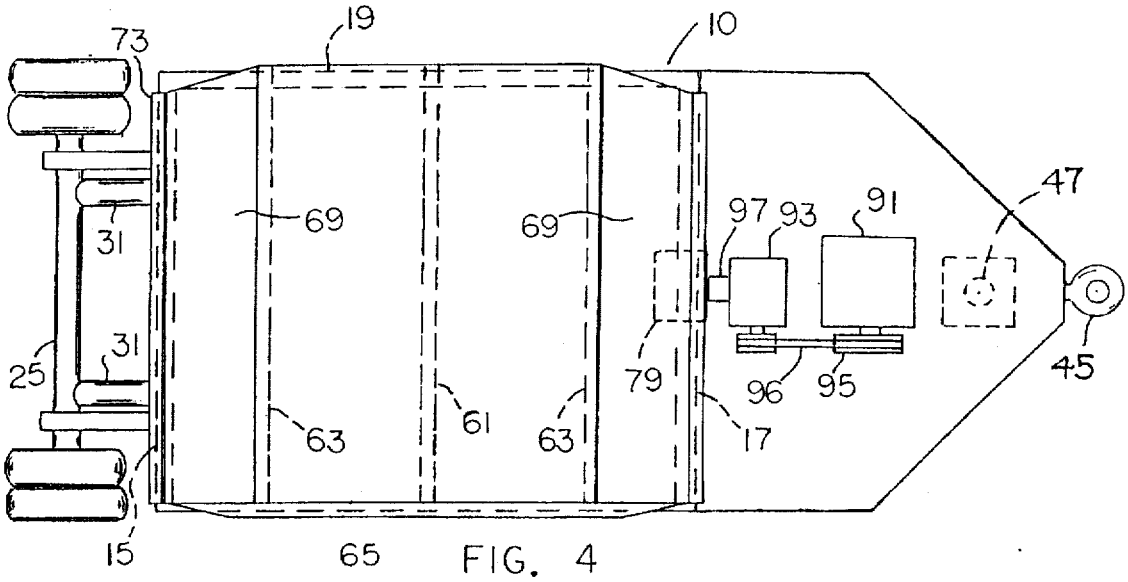
FIG. 4, is a top plan view, of the FIG. 1 apparatus.

FIG. 4, is a top plan view, of the FIG. 1 apparatus.

Referring particularly to FIGS. 1 through 4, there is shown a mobile screening apparatus designed for separating gravel aggregates into coarse and fine fractions. Depending on the mesh of the perforated screen (panel), other types of aggregates can also be accommodated. However, the illustrated apparatus has reinforcement features for resisting high impact forces generated by small rocks and high density gravel. The illustrated apparatus is therefore particularly suited for handling gravel and small rocks of varying sizes and shapes.

The illustrated apparatus comprises an upright box 10 adapted to rest on ground surface 12 for receiving fine gravel particles from an elevated screen assembly 14. Box 10 comprises an upright rear wall 15, an upright front wall 17, and an upright side wall 19. In FIG. 1, the upper edge of side wall 19 is designated by numeral 20. The top end of the box 10 is open to accommodate falling aggregate particles passing through the overhead screen assembly 14. Also, one side of the box is open to gain access to fine gravel particles deposited in the box. In the drawing the open side of the box is designated by numeral 21. Viewed in the top plan direction, box 10 has a U-configuration, comprised of walls 15, 17 and 19.

The illustrated apparatus is designed to be towed by another vehicle, e.g., a truck, whereby the apparatus can be relocated, as necessary to be proximate to particular gravel sources. During the transport phase, from one site to another site, box 10 is elevated from the ground surface, as fragmentarily illustrated in FIG. 3.

Two sets of dual ground wheels 23 are located behind box rear wall 15 for supporting box 10 above the ground surface 12 while the apparatus is being towed. The wheels 23 are rotatably mounted on a non-rotary tubular axle 25 that is connected to the box rear wall 15 by two links 27; the links 27 have pivotal connections 29 with the axle 25 and box rear wall 15.

Two hydraulic cylinders 31 have pivotal connections 33 with the box rear wall and axle, whereby the cylinders 31 are enabled to raise or lower box 10. Each cylinder 31 can be a single acting cylinder connected at its upper end to a suitable hydraulic hose that supplies hydraulic fluid at a suitable pressure, e.g., 2,500 p.s.i. Each cylinder 31 can have a three inch bore and a twelve inch stroke. When each cylinder 31 is pressurized, as shown in FIG. 3, the box 10 is raised from the ground surface. When each cylinder is depressurized, as shown in FIG. 1, box 10 is lowered to rest on ground surface 12. In a hydraulic sense, the two cylinders 31 operate in parallel, using hydraulic fluid from a pump 93 located on a platform 43 at the front end of the apparatus.

When box 10 is in its raised condition, the weight of the box can be absorbed by two elongated tubular struts 35. Each strut 35 has a pivotal connection 37 with the box rear wall 15. The lower end of each strut can be seated in a socket member 39 (FIG. 3) attached to the axle, after cylinders 31 have raised the box 10 to its transport position. A pin 41 can be extended through aligned holes in each strut and the associated socket member 39, to retain the strut in the socket member. During the transport period, each cylinder 31 can be in a depressurized condition.

The illustrated apparatus includes a platform 43 extending forwardly from the box front wall 17. The platform can be formed out of ten inch steel channel welded to the box front wall 17 and interconnected by a steel nose plate; a towing eye 45 is mounted to the nose plate on the longitudinal axis of the apparatus. The overall length of the apparatus, from road wheels 23 to the towing eye 45, may typically be about twenty (20) feet.

A vertically disposed hydraulic cylinder 47 is suitably mounted on platform 43 for raising or lowering the front end of the apparatus. Cylinder 47 can be substantially identical to each cylinder 31. As shown in FIG. 1, cylinder 47 is in a depressurized condition. Cylinders 47 and 31 may be pressurized together (i.e., at the same time) to raise the apparatus to its elevated position. After the apparatus has been connected to the towing vehicle the cylinders can be depressurized.

Figure 6:
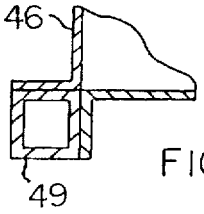
FIGS. 6, 7 and 8 are fragmentary sectional views, of structural details used in the FIG. 1 apparatus.
Figure 8:
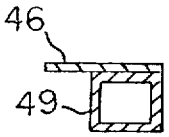
Figure 7:
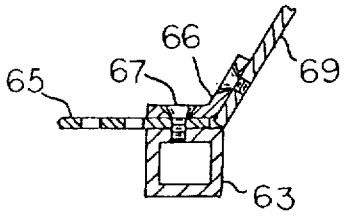

FIGS. 6, 7 and 8 are fragmentary sectional views of structural details used in the FIG. 1 apparatus.

The walls of box 10 are preferably formed of heavy steel plate. As an optional feature, the plate steel walls can be reinforced with square tubing welded to the plate outer surfaces. FIGS. 6 and 8 illustrate a preferred relationship between the steel plate and the tubular reinforcements. In the drawing, numeral 46 designates the steel plate, and numeral 49 designates the tubular reinforcement. FIG. 6 shows a corner construction, e.g., the corner formed between walls 15 and 19. FIG. 8 shows the construction at the free end of wall 15; a similar reinforcement is used at the free end of wall 17.

FIG. 2, shows a preferred reinforced wall structure for the rear wall 15, comprising horizontal and vertical tubes 49 welded together to provide a reinforcement mechanism for the steel plate that defines the interior surface of the box. Wall 17 may be reinforced in similar fashion.

Walls 15 and 17 have upper edges 51 that are sloped downwardly in the direction of side wall 19, as illustrated in FIG. 2. The upper edges of walls 15 and 17 are reinforced by means of steel tubes 49. The reinforcement tubes for the end edges of walls 15 and 17 are extended upwardly, as at 53, to connect with a horizontal beam 55. Beam 55 extends between walls 15 and 17 in the plane of the box open side, to rigidify the box structure.

Screen assembly 14 comprises a rectangular frame 57 spaced above the upper edges of box walls 15, 17 and 19, such that the frame 57 is in a sloped plane 58 extending essentially parallel to upper edges 51 of walls 15 and 17. The sloped frame is defined by four steel tubes 59 welded together to form the peripheral edge of the frame. The sloped frame further comprises a center bar 61 and two side bars 63 extending between two of the peripheral steel tubes 59. Bars 61 and 63 form a support grid for a perforated panel 65 that constitutes the screen for classifying, or separating, the gravel aggregates into coarse and fine fractions. The fine particles fall through the panel perforations, while the coarse (large) particles are retained on the panel.

Perforated panel 65 can be formed in various ways, e.g., by a steel plate having holes pi?punched at spaced points therealong, or by a heavy screen, or by a sheet of expanded metal. The perforated panel 65 is releasably secured to the supporting grid by means of two angle iron retainer strips 66 and screws 67 extending through the panel 65 into bars 61 and 63, and frame elements 59 spanning the bars.

Screen assembly 14 further comprises two upwardly divergent trough walls 69 that have lower edges thereof welded to bars 63, so that the trough walls are contiguous with perforated panel 65. Trough walls 69 act as guides for channeling gravel aggregates onto the panel surface. The trough walls have upper edges 71 that are widely spaced to contain and channel aggregates received from an overhead source, not shown. The aggregates would usually be received from an overhead belt conveyor or the bucket of a front end loader. An end wall 70 is provided at the upper end of the trough to prevent undesired movement of the fluidized aggregates off the upper edge of perforated panel (screen) 65.

The upper edges of trough walls 69 may be reinforced by rectangular tubes 73 extending along the entire length of each wall 69. Walls 69 may be further reinforced by means of tubular struts 75 extending between peripheral edge areas of frame 57 and reinforcement tubes 73. As shown in FIG. 2, there are four struts 75 spaced approximately equidistantly along the length of the illustrated trough wall 69. Each trough wall 69 is preferably a heavy steel plate having a thickness of about three-sixteenths of an inch.

Screen assembly 14 is resiliently supported above box 10 by means of six heavy duty coil springs 77 trained between frame 57 and upper edge areas of the box. Two of the springs are positioned on cross beam 55, as shown in FIG. 1. Two other springs are seated on a reinforcement tube 49 that extends along the upper edge of box side wall 19 directly behind the first mentioned springs (as viewed in FIG. 1). The two intermediate springs are seated on brackets 78 welded to upper edge areas of walls 15 and 17. The springs have their upper ends anchored to frame 57. The springs are preferably identical.

Figure 5:
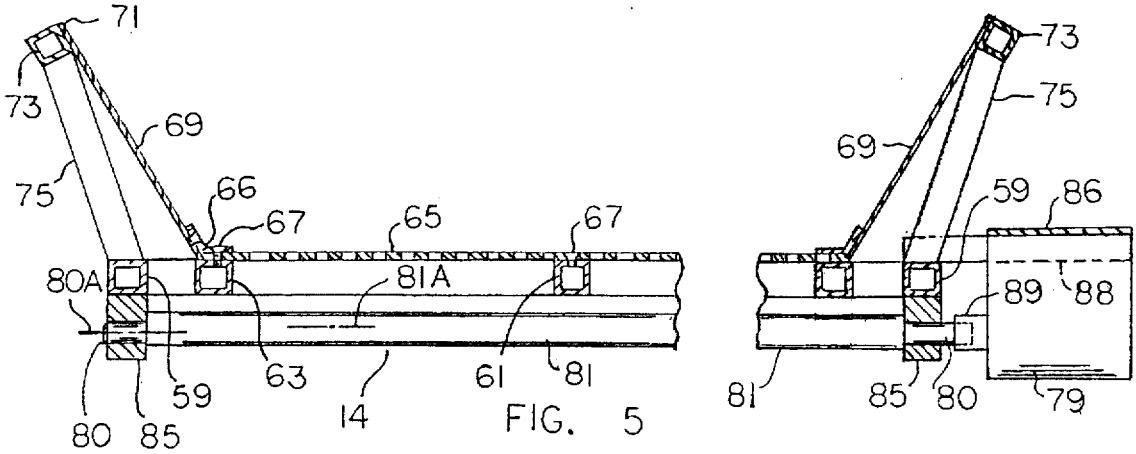
FIG. 5, is an enlarged sectional view, taken on line 5—5 in FIG. 2.

Screen assembly 14 is vibrated in a generally vertical direction by a rotary counterweight system that is driven by a hydraulic motor 79. The counterweight system shown in the drawing comprises an elongated steel shaft 81 extending transversely across the space below trough walls 69, 69. End portions 8C. of the shaft are of reduced diameter so as to extend through bearings 85 that are affixed to frame members 59. As viewed in FIG. 5, the right end of the elongated shaft 81. extends beyond the associated bearing 85 for direct connection to the shaft 89 of hydraulic motor 79. Motor 79 may be suspended from a mounting plate 86 that is supported by two parallel outrigger arms 88 extending from the associated frame element 59. The motor could be mounted on the screen assembly 14 in various ways. Preferably the motor has a direct drive connection to counterweight shaft 81, rather than a belt drive connection.

The reduced diameter shaft end portions 80 may be eccentric to the main body of shaft 81, such that axis 80A of each shaft end portion is eccentric to axis 81A of the counterweight shaft 81. As the hydraulic motor rotates the shaft around axis 80A, the elongated main body portion of the shaft acts as an elongated counterweight to produce a desired oscillation of the screen assembly 14. The six springs 77 restrict the oscillation to a generally vertical direction.

The use of elongated shaft 81 as a counterweight is advantageous in that the shaft will have a relatively large diameter, typically about four and one half inches. The large shaft diameter gives the shaft a desired stiffness in the radial and torsional directions, so that the shaft has minimal deflection while it is rotating. The energy imparted to the shaft by motor 79 translates into oscillation of the screen assembly 14, rather than radial or torsional deflection of the shaft.

In preferred practice of the invention the screen assembly 14 is resiliently supported by six coil springs 77 arranged in two rows along the upper edges of walls 15 and 17. The intermediate springs, seated on brackets 78 (FIG. 2) provide some support for the mid area of the screen assembly 14, thereby helping to extend the service life of the screen assembly. The coil springs are preferably identical to each other as regards length, number of coils, coil wire diameter, and deflection characteristics. By using at least six springs to support the screen assembly, the service life of each spring is somewhat improved, due to the fact that the load is shared by a relatively large number of springs.

An engine 91 is mounted on platform 43 for powering hydraulic pump 93, via a drive system that includes pulleys 95 and a drive belt 96. The pump 93 output may be regulated by a manual control valve 97, that controls the pressure in a line leading to motor 79. The return line from motor 79 connects with a sump 99 in pump 93.

Pump 93 can also supply pressure fluid to the aforementioned cylinders 31 and 47. A selector valve is provided so that the pump output is applied either to motor 79 or to cylinders 31 and 47, as necessary.

The three sided box 10 circumscribes a vacant space that receives the relatively fine particles that pass through the perforated screen 65. Normally the particles will accumulate on the ground surface within box 10. However, if desired, a container (not shown) can be positioned within box 10 to receive the relatively fine particles.

Alternatively, box 10 can be used to support a funnel-shaped hopper that guides the relatively fine particles onto a belt type conveyor, not shown. FIG. 1, shows in dashed lines a funnel-shaped hopped 100 having flanges adapted to rest on rails 101 affixed to the inner surfaces of box walls 15 and 17. The funnel-shaped hopper 100 has an open lower end adapted to discharge relatively fine particles onto the end of a belt conveyor (not shown) that conveys the particles out of the box, e.g., to a truck. Hopper 100 serves as a guide for concentrating the particle stream discharged through screen 65.

The side opening in box 10 enables the apparatus to be turned in a reverse direction for leaving a pile of gravel on ground surface 12. Thus, if the towing vehicle exerts a pulling force on eye 45 to turn the apparatus through a one hundred eighty degree arc, eye 45 will face in the opposite direction so that box 10 is clear of the gravel pile.

A principal feature of the invention is that screen assembly 14 is elevated above box 10, whereby the operating components 79, 85 and 81, are visible and readily accessible for inspection or repair purposes. Another feature of the invention is that trough walls 69 are contiguous with screen 65. There is no possibility of aggregates collecting in clearance spaces between a stationary trough and an oscillating screen; in the illustrated arrangement the trough is an integral part of the screen assembly so that the cloggage problem is eliminated.

The counterweight system for oscillating screen assembly 14 preferably comprises an elongated shaft 81 having eccentric end portions 80 extending through radial bearings so that rotation of the shaft produces a desired oscillation of the screen assembly, Pith minimal shaft deflection.

The present invention described above, relates to a mobile gravel screening apparatus. Features of the present invention are recited in the appended claims. The drawings contained herein necessarily depict structural features and embodiments of the mobile gravel screening apparatus, useful in the practice of the present invention.

However, it will be appreciated by those skilled in the arts pertaining thereto, that the present invention can be practiced in various alternate forms and configurations. Further, the previous detailed descriptions of the preferred embodiments of the present invention are presented for purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What is claimed is:

1. A mobile aggregate screening apparatus comprising:

a box adapted to rest on the ground surface;

said box comprising a rear wall, a side wall, and a front wall; said front and rear walls having upper edges sloped downwardly in the direction of said box side wall;

a vibratable screen assembly located above said box;

said screen assembly comprising a rectangular frame located in a sloped plane approximately parallel to the plane of said sloped upper edges, a sloped perforated panel positioned on said frame, two upwardly divergent trough walls extending upwardly from said rectangular frame in contiguous relation to said perforated panel, a reinforcement means (73) extending along the upper edge of each said trough wall, and plural struts (75) extending between said frame and each said reinforcement means to absorb loads imposed on the associated trough wall, whereby aggregates deposited onto said trough walls are gravitationally guided onto the perforated panel; and a rotary counterweight system for vibrating said screen assembly in a generally vertical direction;

said counterweight system comprising two aligned bearings mounted on said rectangular frame, and an elongated shaft supported in said bearings for rotary movement around a rotational axis defined by the bearings;

said elongated shaft having a principal axis offset from the bearing axis, whereby said shaft acts as a counterweight.

2. The aggregate screening apparatus, as described in claim 1, and further comprising a motor mounted on the screen assembly frame in direct driving connection to said elongated shaft.

3. A mobile gravel screening apparatus comprising:

a three sided box having an open top and an open bottom, said box having a rear wall, a side wall, and a front wall;

a pair of road wheels located in near proximity to said rear wall for supporting said box in a raised position spaced above the ground surface;

means for retracting said wheels upwardly whereby said box can be lowered to rest on the ground surface;

a platform extending forwardly from said box front wall;

a lowerable landing leg extending downwardly from said platform for supporting said platform in a raised or lowered position;

said front and rear walls of the box having upper edges sloped downwardly in the direction of said box side wall;

a vibratable screen assembly located above said box;

said screen assembly comprising a rectangular frame located in a sloped plane approximately parallel to the plane of said sloped upper edges on the box front and rear walls;

said screen assembly further comprising a sloped perforated panel positioned on said frame, said perforated panel having two parallel edges paralleling the plane of the box front and rear walls, and two trough walls extending upwardly from said frame for channeling gravel onto the perforated panel;

said trough walls having lower edges in near proximity to said parallel edges on the perforated panel;

said trough walls having upper edges spaced further apart than said lower edges, whereby gravel discharged into the screen assembly is guided onto the perforated panel;

means for vibrating said screen assembly;

said vibrating means comprising an engine mounted on said platform, a hydraulic pump driven by said engine, and a hydraulic motor mounted on said rectangular frame; and a rotary counterweight system for vibrating said screen assembly in a generally vertical direction;

said counterweight system comprising two aligned bearings (85) on said rectangular frame, and an elongated shaft having reduced diameter end portions supported in said bearings, whereby said shaft is rotatable around a rotational axis defined by the bearings; and said elongated shaft having a principal axis offset from the bearing axis, whereby said shaft serves as a rotary counterweight.

4. The gravel screening apparatus, as described in claim 3, and further comprising coil spring means extending between said box and the rectangular frame of said screen assembly, whereby the screen assembly is resiliently supported above the box; and said coil spring means comprising three equidistantly spaced coil springs extending from the upper edge of said box rear wall, and three equidistantly spaced coil springs extending from the upper edge of said box front wall.

5. A mobile aggregate screening apparatus comprising:

a box adapted to rest on the ground surface;

said box comprising a rear wall, a side wall, and a front wall; said front and rear walls having upper edges sloped downwardly in the direction of said box side wall;

a vibratable screen assembly located above said box;

said screen assembly comprising a rectangular frame located in a sloped plane approximately parallel to the plane of said sloped upper edges, a sloped perforated panel positioned on said frame, and two upwardly divergent trough walls extending upwardly from said rectangular frame in contiguous relation to said perforated panel, whereby aggregates deposited onto said trough walls are gravitationally guided onto the perforated panel; and a rotary counterweight system for vibrating said screen assembly in a generally vertical direction;

said counterweight system comprising two aligned bearings mounted on said rectangular frame, and elongated shaft supported in said bearings for rotary movement around a rotational axis defined by the bearings, and a motor mounted on said screen assembly in direct connection to said elongated shaft;

said elongated shaft having a principal axis offset from the bearing axis, whereby said shaft acts as a counterweight; said elongated shaft comprising a main body portion (81) and two end portions extending from said main body portion through said bearings; and said shaft end portions having a lesser diameter than said main shaft portions.

6. The aggregate screening apparatus, as described in claim 5, and further comprising plural coil springs extending between said body and the rectangular frame of said screen assembly, whereby the screen assembly is resiliently supported above said box; and said coil springs comprising three coil springs extending upwardly from the upper edge of the box front wall, and three coil springs extending upwardly from the upper edge of the box rear wall.

7. The aggregate screening apparatus, as described in claim 6, wherein said coil springs are equidistantly spaced along the respective front and rear walls of the box.

* * * * *